US005772429A

United States Patent [19]

Fehrenbach et al.

[11] Patent Number: 5,772,429

[45] Date of Patent: Jun. 30, 1998

[54] PORTABLE OVEN FOR HEATING OF TILES

[76] Inventors: Michael James Fehrenbach; Carol Mawyer Fehrenbach, both of 15 Fox Creek Dr., Rehoboth, Del. 19971

[21] Appl. No.: 754,182

[22] Filed: Dec. 18, 1995

[51] Int. Cl.[6] ..... F27B 3/18

[52] U.S. Cl. ..... 432/162; 432/120; 432/199

[58] Field of Search ..... 432/120, 152, 432/162, 168, 169, 176, 199

[56] References Cited

U.S. PATENT DOCUMENTS

| | | | |
|---|---|---|---|
| 839,581 | 12/1906 | Harman | 432/162 |
| 4,471,834 | 9/1984 | Schlote | 165/4 |
| 4,544,024 | 10/1985 | Baggott | 165/48 R |
| 4,582,301 | 4/1986 | Wunning | 432/199 |
| 4,730,100 | 3/1988 | Pingelton | 219/400 |
| 4,927,358 | 5/1990 | Tamura et al. | 432/162 |
| 4,951,648 | 8/1990 | Shukla et al. | 432/199 |
| 5,188,013 | 2/1993 | Cardinale | 83/879 |
| 5,375,587 | 12/1994 | Ward et al. | 126/190 |
| 5,378,144 | 1/1995 | Cress | 432/162 |

*Primary Examiner*—Henry A. Bennett
*Assistant Examiner*—Jiping Lu
*Attorney, Agent, or Firm*—Huntley & Associates

[57] ABSTRACT

A portable oven for simultaneous preparation of multiple floor tiles, providing an efficient means to heat the tiles so they are soft and can be cut to fit the area to be tiled, and preferably providing means to measure and cut the heated tiles.

3 Claims, 2 Drawing Sheets

Fig.2.
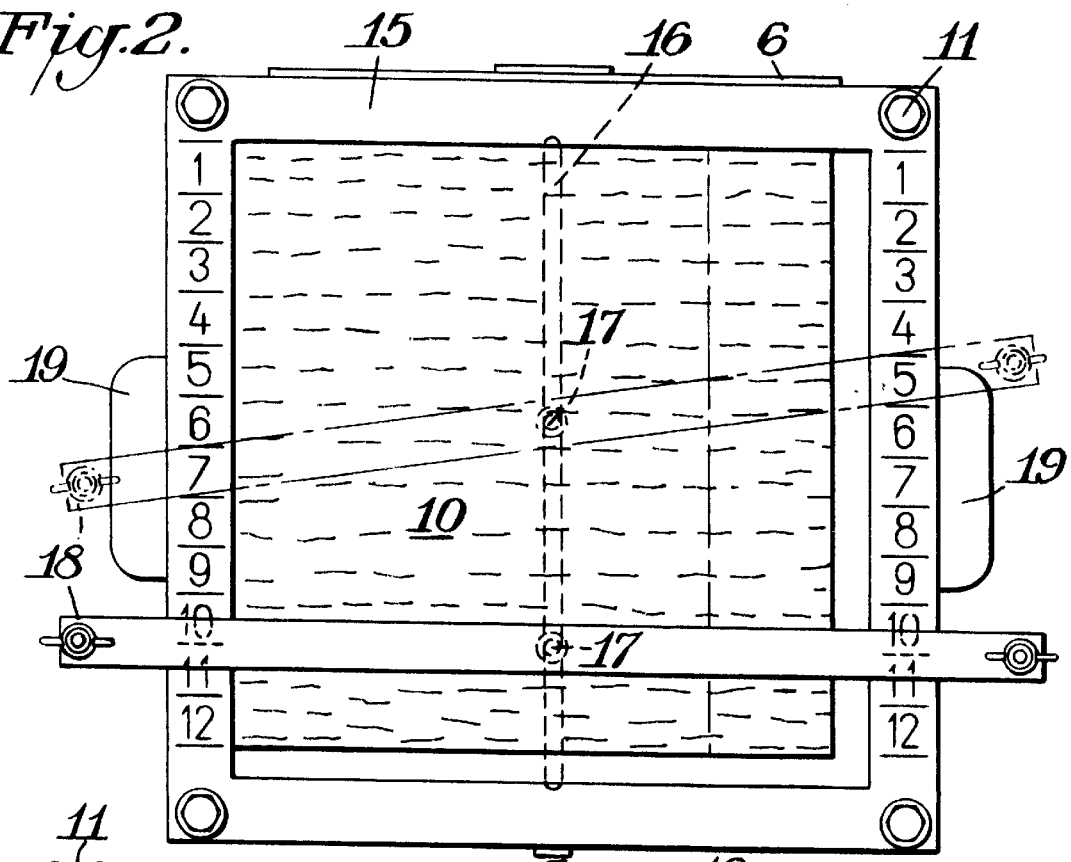
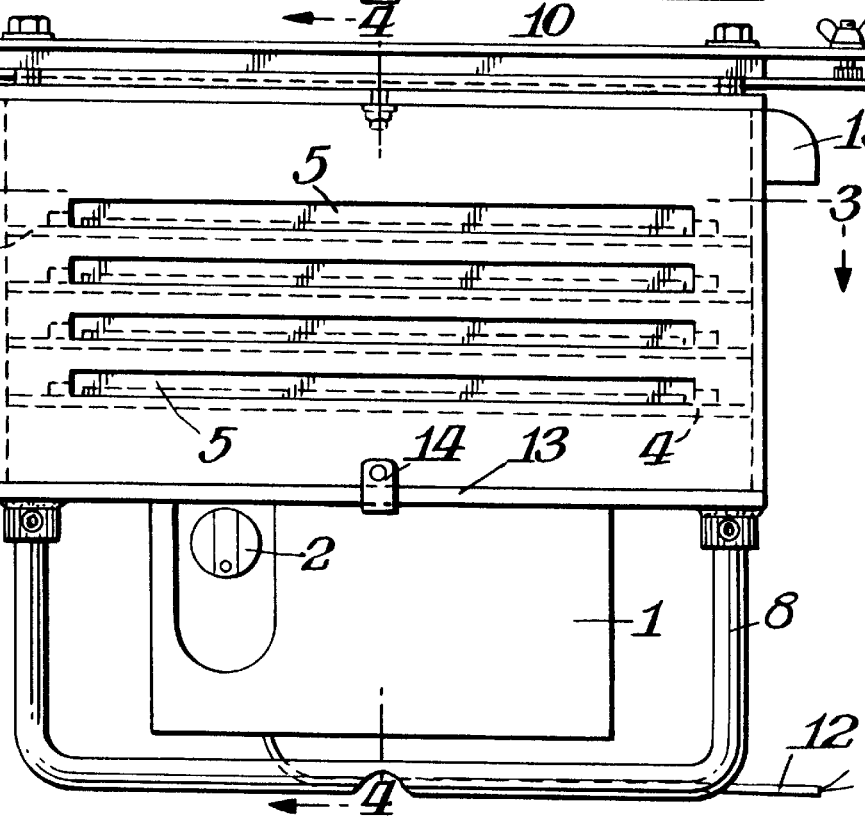
Fig.1

PORTABLE OVEN FOR HEATING OF TILES

BACKGROUND OF THE INVENTION

The installation of vinyl floor tile often requires that the tile be cut to fit into irregular areas, usually along walls, other abutments or obstructions such as pipes. In order to achieve a clean cut and successfully fit the tile into the desired space, it should be heated prior to cutting. Once heated, the tile is soft and easier to cut. In the past, hand held heating devices similar to blow-dryers for hair were used to heat and soften each tile prior to cutting. Although the blow-dryers were adequate to heat the tile, their use proved to be time consuming and inefficient, requiring the continuous efforts of an individual to direct the hot air at the tile until the tile was soft enough to be cut. Consequently, a need existed for a device to more efficiently heat the tiles without requiring the constant efforts of the individual installing the tile.

Previous attempts to satisfy this need include the device disclosed in Cardinale, U.S. Pat. No. 5,188,013, which shows an apparatus with a warming plate for the heating of an individual tile, the warming plate being ruled and being connected to a means for measuring and scoring the tile for cutting. The Cardinale device, relying on direct contact between the heating surface and the tile, is limited to heating one tile at a time, and is further limited by the fact that it must be located adjacent to the area where each tile is to be placed, requiring the device to be moved to a new position for every tile. A need remains for a more efficient means to heat and cut floor tile to facilitate installation.

SUMMARY OF THE INVENTION

The present invention provides a portable oven for the heating of vinyl floor tiles, preferably combined with a device to measure and cut the individual heated tiles, and a cutting surface.

Specifically, the oven of the invention comprises a substantially rectilinear cabinet having front and back sides, and a top and a bottom; a plurality of perforated substantially horizontal shelves within the cabinet; apertures in the front and back sides of the cabinet adjacent to two opposite ends of each of the shelves; heating means mounted at the bottom of the cabinet, beneath the shelves; and at least one substantially vertical passageway communicating from the heating means to each shelf.

The oven preferably further comprises a cutting surface; a means to measure and cut a tile; at least one handle mounted on the cabinet; a means of locomotion such as wheels below the cabinet; and a storage drawer below the heater.

BRIEF DESCRIPTION OF THE DRAWINGS

FIG. 1 is a front elevational view of an oven of the invention.

FIG. 2 is a top plan view of an oven of the invention, with a pivoting straight edge guide for cutting tiles shown in phantom outline in a pivoted position for angular cuts.

DETAILED DESCRIPTION OF THE INVENTION

Figure 3:
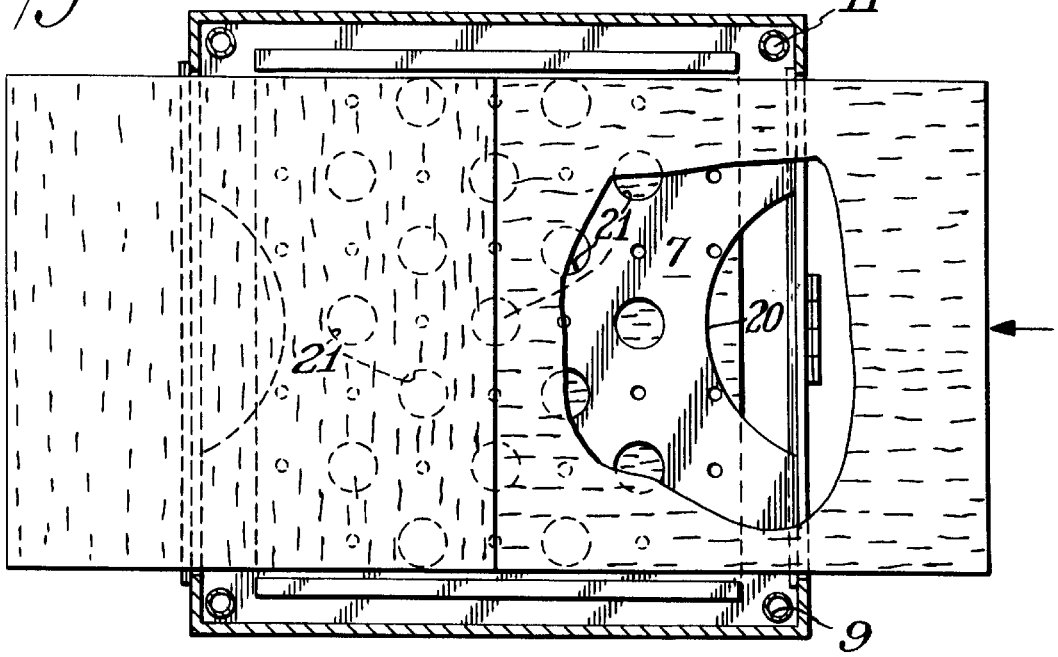
FIG. 3 is a top cross sectional view taken at 3—3 of FIG. 1 and partially broken away to show an example of preferred heat conducting features and the presence of tiles within the top chamber of the oven.

The invention will be more fully understood by reference to the drawings, which show one embodiment of the oven.

Variations and modifications of this embodiment can be substituted without departing from the principles of the invention, as will be evident to those skilled in the art.

FIG. 1 is a front elevational view of an oven of the invention showing a heating means 1 and power switch 2 located beneath below the oven cabinet 3. The oven has four perforated shelves 4 within the cabinet on which tiles can be placed. Apertures 5 formed in opposite sides of the cabinet allow access to the shelves within. Compartments within the cabinet are defined by the cabinet walls at each end of each shelf, and the shelf, and are accessed through the apertures. Tiles pushed through each aperture and onto the adjacent shelf can then be heated within the compartment. Each compartment has two apertures at opposite ends of the oven cabinet. Preferably, pivoting closure doors 6, are provided, mounted on the cabinet to close each individual aperture. The closure doors preferably pivot both inwardly and outwardly to allow insertion and removal of a tile from either side, and provide the additional benefit of preventing heat from escaping the oven cabinet, thus increasing the energy efficiency of the oven, as well as insuring that the heating time of each tile remains relatively consistent. Each compartment preferably has positioning guides to aid in the positioning tiles upon the perforated shelf 4 located within that compartment. The positioning guides also help to prevent the tile from becoming wedged in a diagonal position within the cabinet. The cabinet is preferably equipped with handles 19 for movement of the oven, which are shown mounted on the two sides of the cabinet which do not have apertures for insertion and removal of the tiles.

The cabinet can be mounted on a wide variety of supporting means. In this embodiment, tubular legs 8 are provided to position the cabinet above the heating means. These legs extend vertically through the cabinet and are threaded at the top end 9, allowing a cutting surface 10 to be secured by bolts 11 above the cabinet. The heating means is preferably provided with a switch to turn it on or off, and in the particular embodiment here shown, has a power cord 12, which can be retractable. Directly above the heating means and below the perforated shelves is the floor panel 13 of the cabinet, which is secured by a latch 14, permitting the floor panel to be removed for cleaning, maintenance, or other purposes.

FIG. 2 is a top plan view of an oven of FIG. 1, showing a recessed cutting surface 10. The cutting surface is bolted to the tubular legs 8 which position the cabinet 3 and cutting surface above the heating means 1. A wide variety of heating means can be used, consistent with the overall size of the oven and the number of shelves. However, in general, heaters capable of generating about 500–1500 watts, combined with a fan means, have been found to be satisfactory in the present invention. The cutting surface can be ruled so that the operator can place the tile correctly in relation to the straight edges surrounding the cutting surface. The cutting surface is preferably surrounded on four sides by a raised edge 15, as shown, which can be marked in inches or otherwise ruled for measurement of the tile to be cut. In the embodiment of the invention shown here, a guide slot 16 positioned above and bisecting the cutting surface accepts a pivot guide pin 17, which secures a pivoting tile cutter straight edge or sliding arm 18 into any position desired. This allows the operator to cut the tile in various ways and at different angles so it can be fitted into irregularly shaped areas. FIG. 2 also shows handles 19 attached to the cabinet, as well as a pivoting closure door 6 in the closed position.

FIG. 3 is a top cross sectional view taken at 3—3 of FIG. 1 and partially broken away to show a substantially vertically oriented passageway 20 for the communication of heat between the individual shelves within the cabinet and the heating means. FIG. 3 also shows the perforations 21 on each shelf 7, another heat conducting feature. Tiles are shown on the top two shelves of the oven. The upper tiles are shown as partially transparent and partially broken away to reveal the perforated shelf upon which they are resting. FIG. 3 also illustrates how a heated tile can be forced out of a compartment when a new tile is placed in that same compartment, thus eliminating the need for a spatula or other tile removal device.

Figure 4:
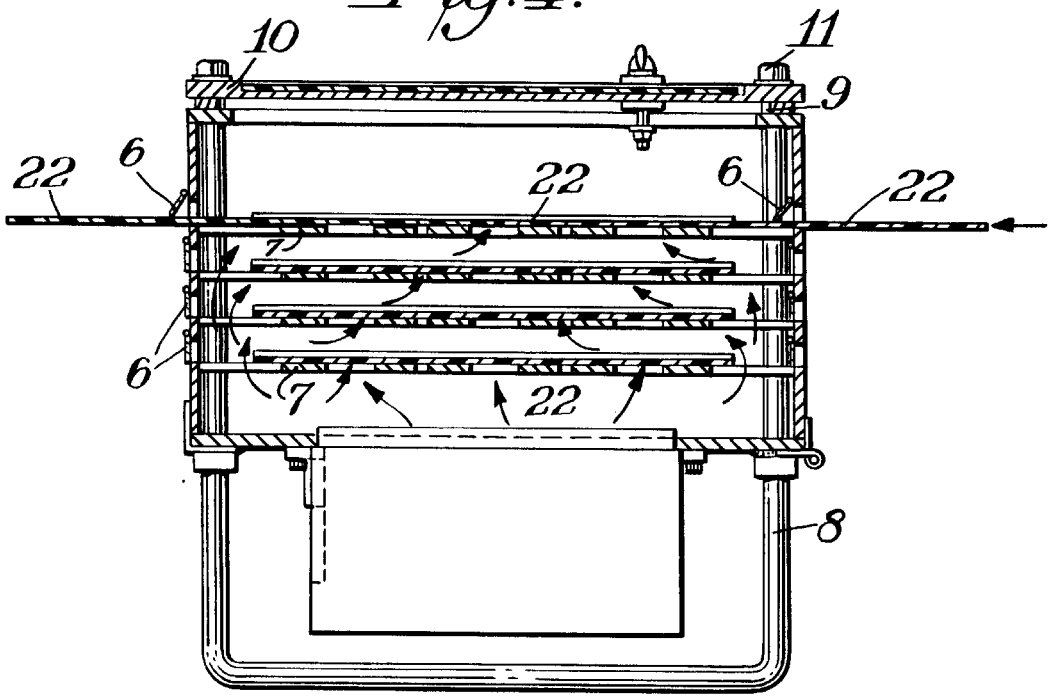
FIG. 4 is a side elevational cross sectional view of the oven taken at 4—4 of FIG. 1.

FIG. 4 is a side elevational cross sectional view taken at 4—4 of FIG. 1 showing multiple heating compartments formed by the shelves. A tile 22 is shown on each of the lower shelves, while an upper shelf is shown with a tile being pushed through the pivoting closure door 6 onto the perforated shelf, thus forcing a tile already within the compartment out through the opposite closure door. This demonstrates the function of the pivoting closure doors, which are shown in the closed position on the lower compartments.

The oven provides a means of efficiently preparing floor tiles to be cut to fit into the area to be tiled. The present oven can be used to heat a single tile or multiple tiles without changing its configuration or operation, and thus provides the user with a flexible means of preparing the tiles to be cut to size. The oven is also portable, and can be placed anywhere near the area to be tiled and can remain in that position until the room is tiled. The oven need not be moved adjacent to each individual space wherein a tile will be placed.

This invention also provides a cutting surface and apparatus for shaping and cutting the individual tiles after they are heated. Measurements for the tiles are made independently of the invention, again allowing the oven to remain near the area to be tiled while measurements are made and until the area is completed tiled. By allowing for independent measurement of the individual areas to be tiled, the oven can carry out its function while the tile installer carries out any related function that may be necessary.

One embodiment of this invention is more ergonomically effective than previously available devices because the multi-level oven results in a higher level cutting and measuring surface, so the operator need not kneel down to cut or measure the heated tiles, and the operator need not bend down to move the oven. In addition, the oven can include wheels or similar means for ease of movement.

I claim:

1. An oven for heating at least one floor tile comprising a substantially rectilinear cabinet having front and back sides, and a top and a bottom; a plurality of perforated substantially horizontal shelves for receiving floor tiles within the cabinet: apertures in the front and back sides of the cabinet adjacent to two opposite ends of each of the shelves; heating means mounted at the bottom of the cabinet, beneath the shelves; and at least one substantially vertical passageway communicating from the heating means to each shelf and further comprising a means to measure and cut a tile.

2. An oven of claim 1 wherein the tile measuring and cutting means is mounted on the top of the cabinet, above the cutting surface.

3. An oven of claim 1 wherein the tile measuring and cutting means is pivotally mounted to a sliding arm.

* * * * *

UNITED STATES PATENT AND TRADEMARK OFFICE

CERTIFICATE OF CORRECTION

PATENT NO. : 5,772,429

DATED : June 30, 1998

INVENTOR(S) : Michael James Fehrenbach; Carol Mawyer Fehrenbach

It is certified that error appears in the above-indentified patent and that said Letters Patent is hereby corrected as shown below:

On the title page, change the Serial Number of the application from "754,182" to --574,182--.

Signed and Sealed this

Twenty-fifth Day of August, 1998

Bruce Lehman

*Attest:*

BRUCE LEHMAN

*Attesting Officer*

*Commissioner of Patents and Trademarks*